US009281114B2

(12) United States Patent
Oberle

(10) Patent No.: US 9,281,114 B2
(45) Date of Patent: Mar. 8, 2016

(54) STATOR FOR ELECTRONIC FUEL INJECTOR

(71) Applicant: Buescher Developments, LLC, Cleveland, OH (US)

(72) Inventor: Randy Oberle, Dennison, OH (US)

(73) Assignee: BUESCHER DEVELOPMENTS, LLC, Cleveland, OH (US)

( * ) Notice: Subject to any disclaimer, the term of this patent is extended or adjusted under 35 U.S.C. 154(b) by 113 days.

(21) Appl. No.: 14/203,980

(22) Filed: Mar. 11, 2014

(65) Prior Publication Data

US 2015/0262747 A1 Sep. 17, 2015

(51) Int. Cl.

| | |
|---|---|
| ***H01F 27/02*** | (2006.01) |
| ***H01F 27/30*** | (2006.01) |
| ***H01F 3/00*** | (2006.01) |
| ***H01F 7/00*** | (2006.01) |
| ***F02M 57/02*** | (2006.01) |
| ***H01F 27/245*** | (2006.01) |
| ***H01F 27/28*** | (2006.01) |
| ***F02M 51/06*** | (2006.01) |
| ***H01F 3/02*** | (2006.01) |
| ***H01F 7/128*** | (2006.01) |

(52) U.S. Cl.

CPC ..... *H01F 27/245* (2013.01); *F02M 51/0614* (2013.01); *H01F 3/02* (2013.01); *H01F 7/128* (2013.01); *H01F 27/022* (2013.01); *H01F 27/2823* (2013.01)

(58) Field of Classification Search

CPC ..... H01F 27/28; H01F 38/12; H01F 27/022; H01F 27/325

USPC ..... 336/90, 92, 96, 198; 335/260, 262, 278; 123/446

See application file for complete search history.

(56) References Cited

U.S. PATENT DOCUMENTS

| | | | | |
|---|---|---|---|---|
| 3,602,814 | A * | 8/1971 | Quirk | 324/137 |
| 4,676,478 | A * | 6/1987 | Kiuchi | 251/129.08 |
| 5,155,461 | A * | 10/1992 | Teerman et al. | 335/260 |
| 2003/0116739 | A1 * | 6/2003 | Murao et al. | 251/129.15 |
| 2010/0252001 | A1 * | 10/2010 | Morita et al. | 123/472 |

FOREIGN PATENT DOCUMENTS

JP 2001187979 A * 7/2001

* cited by examiner

*Primary Examiner* — Tsz Chan

(74) *Attorney, Agent, or Firm* — Pearne & Gordon LLP

(57) ABSTRACT

A stator assembly for a fuel valve comprising a magnetic E-core of stacked E-shaped laminations, a plastic bobbin proportioned to surround a central leg of the core, a magnetic wire coil on the bobbin, a non-magnetic metal plate having an O-shaped profile adjacent an end of the bobbin and distal ends of central and outer legs of the E-core, the core, bobbin, coil and plate encapsulated in a block, the block having a pair of vent channels overlying portions of the plate disposed between the outer core legs and the central core leg, the plate being proportioned to pre-stress the outer core legs outwardly prior to encapsulation whereby cyclic strain on the block due to hydraulic forces imposed by high pressure fuel pulses tending to spread the outer core legs is reduced and resistance of the block to cracking due to said fuel pressure pulses is increased.

4 Claims, 3 Drawing Sheets

FIG. 3
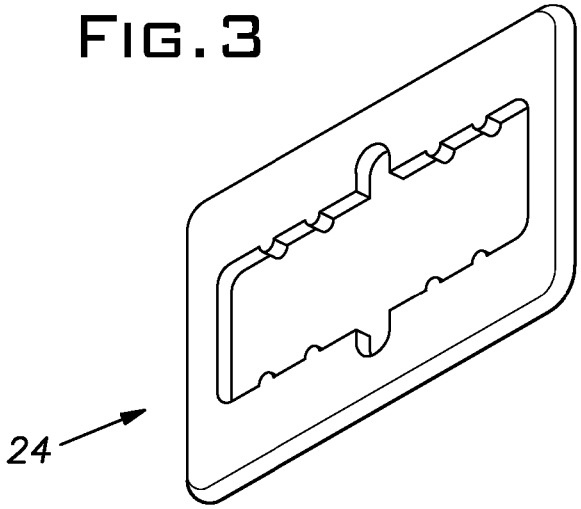
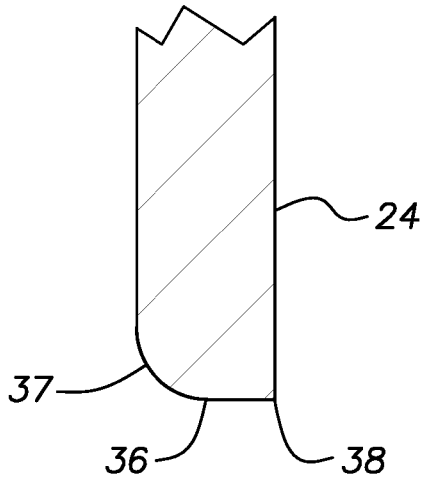
FIG. 5A
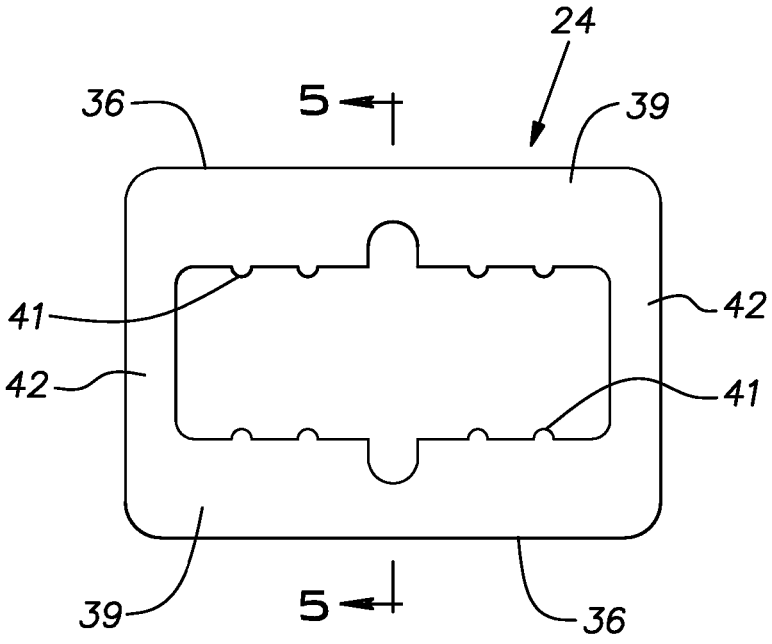
FIG. 4
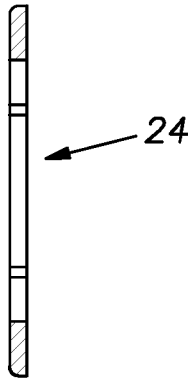
FIG. 5

STATOR FOR ELECTRONIC FUEL INJECTOR

BACKGROUND OF THE INVENTION

The invention relates to electronic fuel injection stator assemblies.

PRIOR ART

Current fuel injection systems for diesel engines typically employ electronic control implemented through a solenoid operated valve. The solenoid valve including its stator assembly, in various engine designs, is exposed to high fuel pressure pulses and surface cavitation in the fuel control circuit as the solenoid switches on and off.

U.S. Pat. No. 5,155,461 proposes an arrangement in a stator assembly to reduce the adverse effects of the cyclical fuel pressure. The patent discloses a plastic bobbin or metal wedges that are proportioned to pre-stress the legs of an E-core lamination so that the cyclical strain on the stator assembly, especially its encapsulating material, is lessened. Consequently, the tendency of the encapsulating material to crack and leak fuel is to be suppressed. Over time, it has been found that commercial articles produced with the E-core pre-stressing plastic bobbins like that disclosed in the patent still fail with cracks developing in the encapsulating material. It is believed that the plastic bobbin could be locally scraped away and plastically deformed when being pressed into position. Additionally, the plastic bobbin material could initially be significantly plastically deformed when put in place and could thereafter creep even in a short time under the pre-stressing forces before the unit was encapsulated. All of these effects could lead to a considerable loss in the level of pre-stressing and, consequently, variability in and shortening of service life of a stator assembly. Further, commercial units of the prior art are known to fail as a result of cavitation induced erosion of the encapsulating material. This erosion occurs in an internal vent area between the legs of the E-core exposed to cavitating fuel being violently displaced by motion of the armature.

SUMMARY OF THE INVENTION

The invention provides a stator assembly for a diesel engine electronic fuel injection valve with improved durability and extended service life. The inventive stator assembly includes a unitary metal wedging plate that serves to pre-stress both outer legs of an E-core. The pre-stressing action reduces a tendency of the assembly encapsulating material to stress crack from repeated high strain cycles caused by fuel pressure pulses. The wedging plate, additionally, increases stator service life by serving as a barrier to protect the magnet wire coil of the assembly from the harmful effects of cavitation.

The wedging plate is preferably stamped from non-magnetic stainless steel and is configured to pre-stress both outer legs of the E-core. In its assembled position, the wedging plate abuts the end surfaces of a bobbin carrying the magnet wire coil. The bobbin is thereby enabled to support the wedging plate against forces tending to buckle elements of the wedging plate extending between the outer core legs. The stamped character of the wedging plate serves to facilitate its press fit assembly into the core, assures that it stays in place in the assembly before encapsulation, and biases the wedging plate including its bridge elements against the end face of the bobbin. The disclosed metal wedging plate avoids variability of the level of pre-stressing previously of concern with the prior art practice of utilizing a plastic bobbin.

BRIEF DESCRIPTION OF THE DRAWINGS

FIG. 3 is an isometric view of a wedging plate of the invention;

FIG. 4 is a plan view of the bottom side of the wedging plate;

FIG. 5 is an enlarged cross-sectional view of the wedging plate taken at the line 5-5 in FIG. 4; and FIG. 5A is an enlarged cross-sectional view of the wedging plate.

DESCRIPTION OF THE PREFERRED EMBODIMENT

Figure 1:
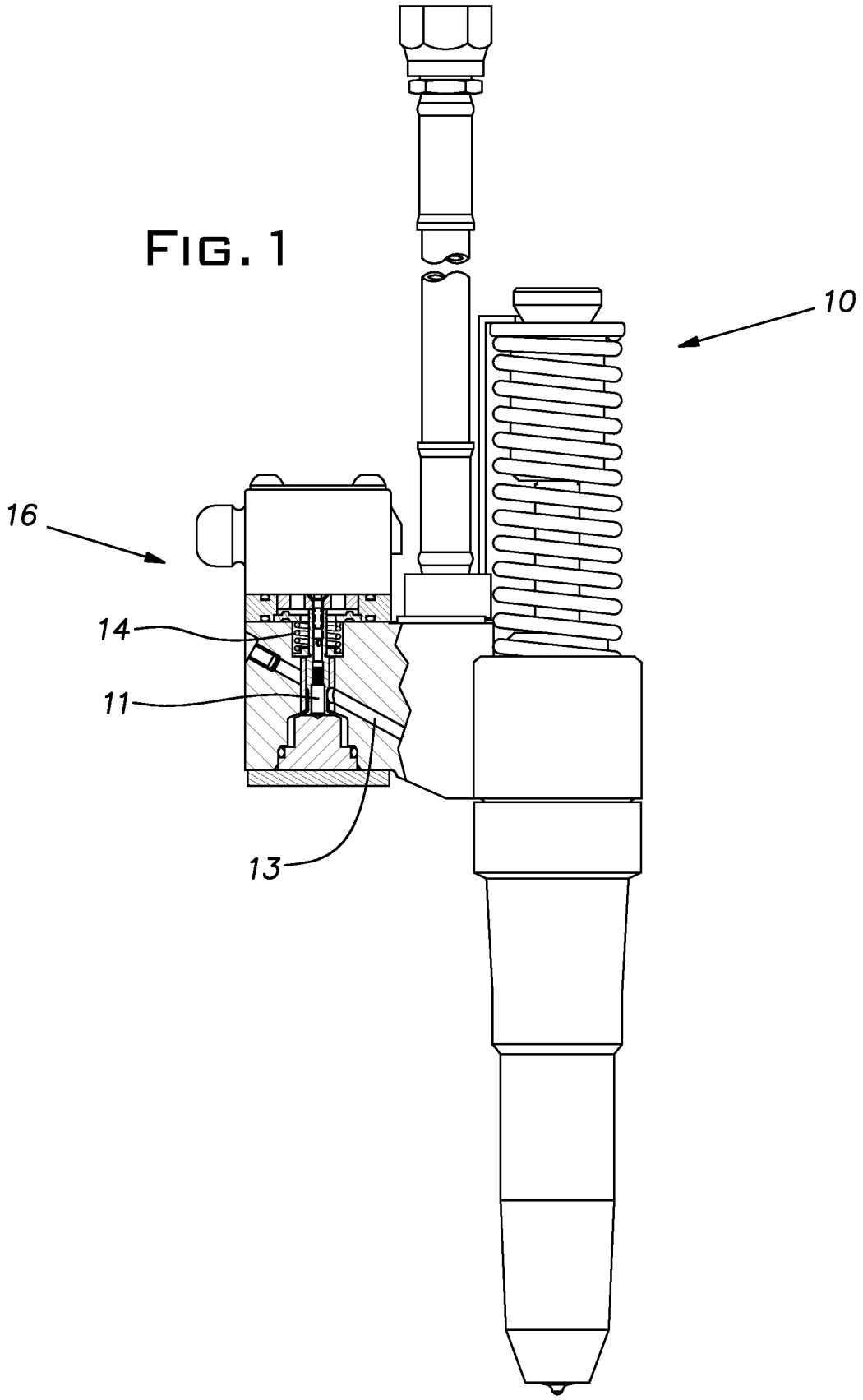
FIG. 1 is an elevational view of an electronic unit injector with a valving portion shown in section.

A diesel engine electronic unit injector 10 of generally conventional construction familiar to those skilled in the art is shown in FIG. 1. The injector 10 includes a valve 11 partially shown in FIG. 2 for controlling the injection of fuel to the cylinder of a diesel engine through a pilot circuit 13. The valve 11 is biased open by a spring 14 and is closed by an electrically operated solenoid assembly 16. The solenoid assembly 16 includes an armature 17 fixed to the valve 11 and a stator assembly 18.

Electrical energization of the stator assembly 18 creates a magnetic field which attracts the armature 17 towards the stator assembly to close the valve 11.

The stator assembly 18 principally comprises an E-core 21, a bobbin 22, a coil 23, a wedging plate 24, and a molded cover 25 encapsulating these elements. The E-core 21 is a stack of E-shaped laminations of magnetic steel. The laminations form a central leg 26 and two outer legs 27. The outer legs 27 are disposed on opposite sides and equally spaced from the central leg 26. The legs 26, 27 are integral with a common cross bar 28.

The bobbin 22 is preferably a unitary molded plastic piece sized to slip over and surround the central leg 26 into the spaces between the central leg and outer legs 27. Each end of the bobbin has a peripheral flange 31, 32. The coil 23 of magnetic wire is wound on the bobbin between the flanges 31, 32. Each wire end of the coil 23 is electrically connected to associated terminals 33 molded in the cover 25 and partially exposed for an external electrical connection.

With the bobbin 22 in place on the E-core 21, the wedging plate 24 is pressed into the spaces between the central leg 26 and outer legs 27. The wedging plate 24, shown in detail in FIGS. 3-5A, is preferably stamped from non-magnetic stainless steel such as 316. The wedging plate 24, is shown in preferred proportion in FIG. 4. The wedging plate 24 has the general shape of a rectangular letter "O" with a length of about 1 inch and a thickness of 0.030 inch, for example. Referring to FIG. 5A, one side of an outer peripheral edge 36 of the wedging plate 24 is characterized in profile by a round over or die roll 37 between the edge and a main face of the wedging plate and the opposite side of the edge is a relatively sharp corner 38 where it meets an associated main face of the wedging plate and may have a small burr extending from the wedging plate proper away from the rounded edge 37. At the inner periphery of the wedging plate 24 along side bars 39 are provided small, yieldable tabs 41 for centering the wedging plate 24 about the central leg 26.

The width of the wedging plate 24, measured from outer edge to outer edge of the side bars 39 is proportioned to be larger than the distance between the core outer legs 27 when the latter are in a free state. The wedging plate 24 with the round over side 37 facing the bobbin 22 is pressed into place so that each side bar 39 lies between an associated outer leg 27 and the center leg 26. To facilitate this assembly, the core outer legs 27 can be provided with surplus length and beveled on their sides facing the center leg 26. The beveled outer leg areas can be removed when the face of the cover 25 and distal ends of the legs 26, 27 are finish ground.

The wedging plate 24 is forced between the core outer legs 27 with the central opening in the plate accepting the center leg 26. The wedging plate 24 is driven into the core space until it finally abuts the adjacent bobbin flange 31. The material of the wedging plate 24 is preferably harder than the material of the E-core laminations so that the sharp corners 38 of the peripheral edge 36 can bite into the core outer legs 27. This assures that the wedging plate 24 will remain in place before the cover 25 is molded and cured in situ. The bobbin flange 31 supports wedging plate bridge elements 42 that extend between the side bars 39. This support prevents the bridge elements 42 from buckling towards the bobbin 22. The contact of the wedging plate side bars 39 is concentrated at their sharp corners 38 so that a tendency of the bridge elements 42 to buckle under the resistance force developed by the core outer legs 27 is biased towards the bobbin flange 31. The total effect is to capture the wedging plate 24 against the bobbin flange 31 so that it is capable of sustaining a relatively large resistance force of the outer legs 27 without a buckling failure before it is encapsulated by the cover 25. Moreover, there is no tendency of the wedging plate 24 to creep and change dimensions under the compressive forces imposed by the stressed core legs 27.

With the wedging plate 24 in place in the E-core 21, the previously described parts are disposed in a mold cavity that is the general shape of the illustrated cover or block 25 and thermosetting material such as an epoxy or phenolic material is injected at high pressure. The material is held at elevated temperatures for a period sufficient to thoroughly cure it.

Figure 2:
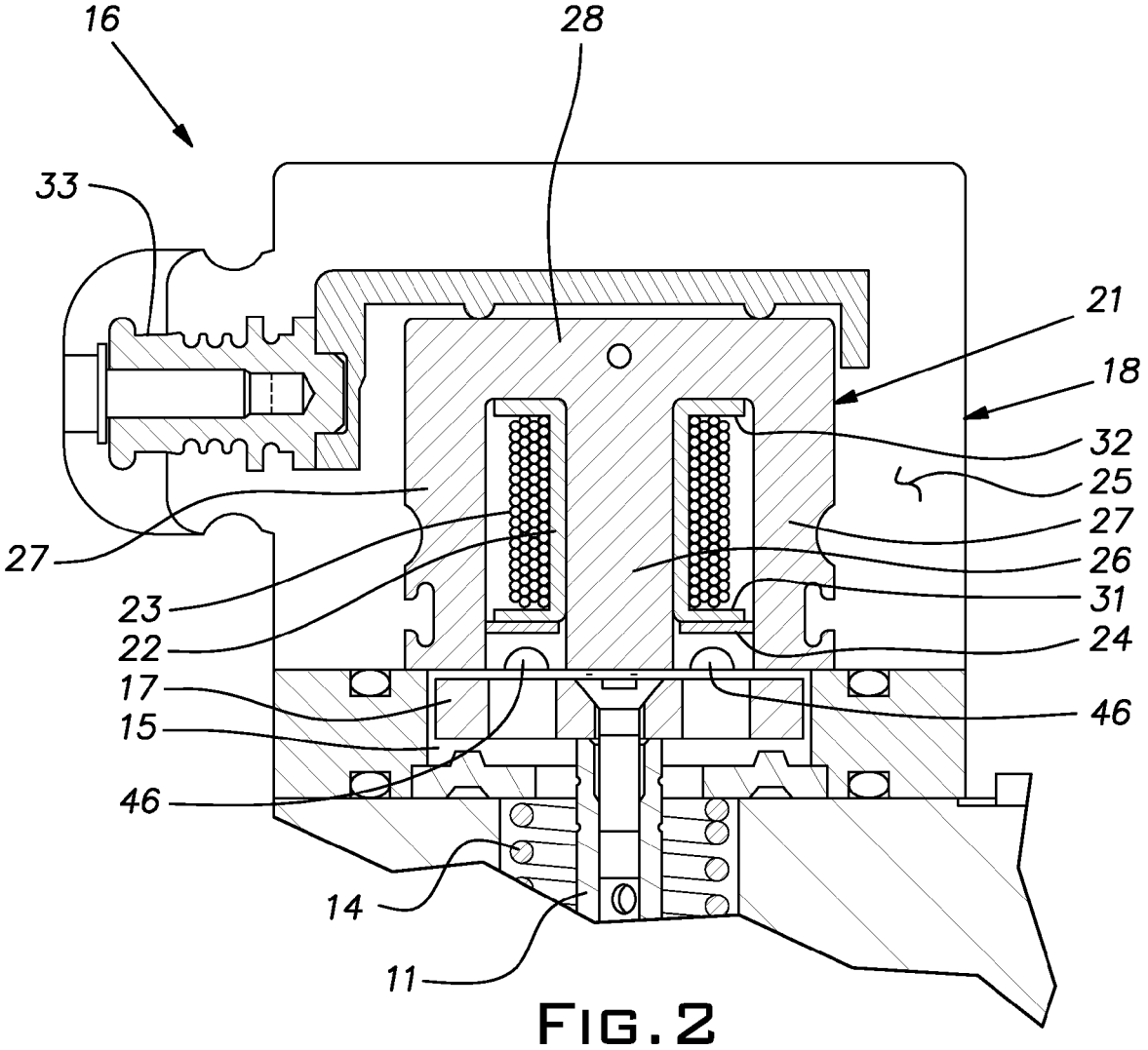
FIG. 2 is an elevational cross-sectional view of the valving section on an enlarged scale and including the stator assembly of the invention.

With reference to FIG. 2, the mold includes details that form two parallel channels 46 in the cover material, each extending between a respective core outer leg 27 and the core center leg 26. The channels 46 are slightly longer than the stack height of the core laminations so that they project beyond the core at each of their ends. The channels 46 serve as vents to allow fuel in the armature chamber, designated 15, to flow across one face of the armature plate 17 to the other depending on the direction of movement of the armature. Fuel pressure pulses in the order of 2,000 psi during engine operation exist in the armature chamber 15 every other revolution of the engine.

When the stator assembly 18 is in service, hydraulic forces of the fuel in the vents or channels 46 urge the cover material forming the channels to push the core outer legs 27 apart. The pre-stress on the core outer legs 27 produced by the wedging plate 24 enables the legs to resist outward cyclic strain particularly where the pre-stress forces are greater than the hydraulic forces. By reducing the cyclic strain in the core outer legs 27, cyclic strain in the material of the cover 25 is reduced. This strain reduction significantly increases the service life of the stator assembly 18. Without a reliable and consistent level of core leg pre-stress, the cover material is prone to crack allowing what can be catastrophic fuel leakage. It is believed that prior art stator assemblies that employed a plastic bobbin to pre-stress an E-core suffered from inconsistent and low level pre-stressing and, consequently, limited service life.

The rapid motions of the armature 17 induces cavitation of the fuel existing between the armature and opposed face of the stator assembly 18. This cavitation leads to erosion of the cover material surrounding the vents 46. Eventually, cavitation, which is known to occur at an accelerating rate, will destroy the coil 23 causing the associated injector 10 to cease operation. Migration of fuel into the body of the cover through erosion will promote cracks in the cover and fuel leakage. It has been demonstrated that the wedging plate 25 can resist erosion much more effectively than the plastic cover material and, accordingly, can extend the service life of the stator assembly 18. It will be noted that the bridge elements 42 also shield the coil 23.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A stator assembly for controlling fuel delivery to a diesel engine comprising a magnetic E-core of stacked E-shaped laminations, a plastic bobbin proportioned to surround a central leg of the core, a coil of magnetic wire wound on the bobbin, a non-magnetic metal wedging plate having an O-shaped profile adjacent an end of the bobbin and distal ends of central and outer legs of the E-core, bobbin, coil and plate being encapsulated in a monolithic block of thermosetting plastic, the block having a pair of vent channels overlying portions of the plate disposed between the outer core legs and the central core leg, the plate being proportioned to pre-stress the outer core legs outwardly prior to encapsulation by said thermosetting plastic whereby cyclic strain on the block due to hydraulic forces imposed by high pressure fuel pulses tending to spread the outer core legs is reduced and resistance of the block to cracking due to said fuel pressure pulses is increased and the service life of the stator assembly is extended, said metal wedging plate being a unitary sheet metal stamping and being characterized by die roll round-over edges as a result of the stamping formation, said round-over edges facing in a direction towards the bobbin.

2. A stator assembly as set forth in claim 1, wherein the wedging plate is situated between a face of the stator assembly subjected to high fuel pressure cycles and the coil such that the plate serves as a barrier to slow cavitation erosion to the coil.

3. A stator assembly as set forth in claim 1, wherein said wedging plate abuts the bobbin, a corner edge of the wedging plate opposite said round-over edge is relatively square and serves to bias any tendency of the wedging plate to buckle in the direction of the bobbin.

4. A stator assembly as set forth in claim 3, wherein said wedging plate is harder than the material of said E-core, the opposite corner edge being adapted to bite into the body of the E-core to hold it in a precise assembled position.

* * * * *